United States Patent [19]

Trevathan

[11] Patent Number: 4,679,711

[45] Date of Patent: Jul. 14, 1987

[54] MULTI-ORIFICE ZERO CAVITY NOZZLE DISPENSER

[75] Inventor: Larry C. Trevathan, Westlake, Ohio

[73] Assignee: Nordson Corporation, Amherst, Ohio

[21] Appl. No.: 774,656

[22] Filed: Sep. 11, 1985

[51] Int. Cl.[4] ..... B67D 5/34

[52] U.S. Cl. ..... 222/330; 222/486; 222/487; 222/506; 222/509; 222/518; 137/868; 251/253

[58] Field of Search ..... 222/149, 334, 330, 484–487, 222/482, 506, 509, 504, 518, 318, 424; 137/867, 868; 251/253; 118/255

[56] References Cited

U.S. PATENT DOCUMENTS

| | | | |
|---|---|---|---|
| 679,064 | 7/1901 | Stone | 222/509 X |
| 2,539,221 | 1/1951 | Badeaux | 137/868 X |
| 3,261,502 | 7/1966 | Guillermic | 222/318 X |
| 3,991,917 | 11/1976 | Moen | 222/506 X |
| 4,157,149 | 6/1979 | Moen | 222/486 |
| 4,212,627 | 7/1980 | Gellert | 222/509 X |
| 4,225,638 | 9/1980 | Waugh . | |
| 4,352,462 | 10/1982 | Watanabe et al. . | |
| 4,465,211 | 8/1984 | Boone . | |
| 4,465,212 | 8/1984 | Boone . | |
| 4,582,231 | 4/1986 | Warning, Jr. | 222/509 X |

FOREIGN PATENT DOCUMENTS 2074049 10/1981 United Kingdom .

OTHER PUBLICATIONS

Brochure—Airprint Systems, Inc. "Pioneer X Extrusion Head/Pkg.".

Brochure—phd "Series 0180 Rotary Actuators".

*Primary Examiner*—Charles A. Marmor

*Attorney, Agent, or Firm*—Wood, Herron & Evans

[57] ABSTRACT

A valved device for dispensing multiple closely spaced streams of liquid from a plurality of dispensing orifices. The device includes selectively actuatable valve needles associated with each of the dispensing orifices for controlling liquid flow from the orifices. A pair of oscillatable cam shafts, each having multiple cam surfaces of different configurations, controls actuation of the valve needles.

6 Claims, 4 Drawing Figures

MULTI-ORIFICE ZERO CAVITY NOZZLE DISPENSER

This invention relates to liquid dispensing devices and more particularly to devices for dispensing relatively viscous, sticky substances such as adhesives, hot melts, and sealing compounds.

There are many liquid dispenser applications in which it is desirable or necessary to sharply cut off the flow of viscous liquid from the nozzle of the device without any drooling, dripping, or stringing of the liquid from the nozzle. To that end, there have been developed liquid dispensing devices or guns which are capable of sharply cutting off the flow of liquid from a nozzle when a valve associated with the nozzle is closed. One such dispenser is illustrated in U.S. Pat. No. 4,465,212.

There are also many liquid dispenser applications for dispensing multiple closely spaced streams of viscous liquid wherein it is desirable or necessary to be able to sharply cut-off the flow of the liquid without any stringing, drooling or dripping of the liquid from the nozzle after closing of the nozzle valve. In many such applications, multiple closely spaced beads of adhesive or other viscous liquid are placed side-by-side so that when the adhesive is compressed, the multiple beads spread and cover a complete surface area. The need for sharp cut off of flow from the nozzles in such applications arises because of the need for applying the beads to discontinuous surfaces, as for example multiple spaced articles moving past a stationary multi-orifice nozzle. Such multi-orifice nozzles with sharp cut off of flow from the nozzles have been developed and are part of the prior art.

One problem which has heretofore characterized all multi-orifice valved type dispensers which are capable of dispensing multiple parallel streams of adhesive and sharply cutting off the flow of adhesive upon closing of the valves associated with the nozzle orifices, is that such guns have heretofore been capable of applying only one pattern of adhesive or one pattern of parallel beads of liquid to a substrate. As a consequence, where there is a need to switch from one width of pattern to another, as for example, from ten parallel beads of adhesive covering a one inch wide pattern to fifteen beads covering a one and one-half inch wide pattern, it has heretofore been necessary to change the complete valved dispenser because such dispensers were not adjustable in the sense of being capable of changing from one pattern to another or from one number of parallel beads to a different number of parallel beads dispensed from the same gun and the same nozzle.

It has therefore been a primary objective of this invention to provide a valved type of liquid dispenser for dispensing multiple parallel beads of viscous adhesive from multiple orifices wherein the dispenser is capable of positive sharp cut-off of adhesive flow from the orifices and which is capable of adjustment to vary the pattern of adhesive dispensed from the multiple orifices of the dispenser.

The dispenser of this invention which is capable of dispensing multiple closely spaced beads of adhesive and of sharply cutting off the flow of those beads without any stringing or drooling of adhesive from the nozzle orifice, while still enabling the pattern of the beads to be varied or adjusted without any need to change guns or nozzles of the gun, comprises a nozzle having a plurality of parallel axial liquid flow bores therein, each bore of which terminates in an outlet orifice. Each bore contains a valve seat. An axially movable valve needle is contained within each bore and includes a valve section engageable with the valve seat to control and sharply cut off liquid flow from the orifice within which the valve is movable. Each valve needle is independently spring biased to a closed position of its valve section relative to the mating valve seat in the nozzle. Each valve needle includes a cam surface engageable with an oscillatable actuator for controlling opening and closing movement of the valve needle relative to its associated valve seat. According to the practice of this invention, this actuator is adjustable and has multiple cam surfaces formed thereon engageable with the cam surface of the valve needles to vary the number and positioning of the valve needles actuated by the selected cam surface of the actuator. In the preferred embodiment of the invention, the valve needle actuator comprises a pair of independently oscillatable cylindrical cams, each of which has multiple longitudinally extending cam surfaces formed thereon. Each longitudinally extending cam surface of each cam is of differing length or configuration than the other cam surfaces of the cylindrical cams such that alignment of any one longitudinally extending cam surface with the cam surface of the valve needles causes a unique pattern of valve needles to be actuated when that cam surface is oscillated relative to the cam surface of the valve needles.

The primary advantage of this invention is that it enables multiple different patterns of adhesive or other viscous liquid materials to be dispensed from the nozzle without the need to change guns or nozzles to effect the change while still maintaining a dispenser which is capable of sharp and positive cut-off of the flow pattern from the nozzle.

These and other object and advantages of this invention will be more readily apparent from the following description of the drawings in which.

Figure 1:
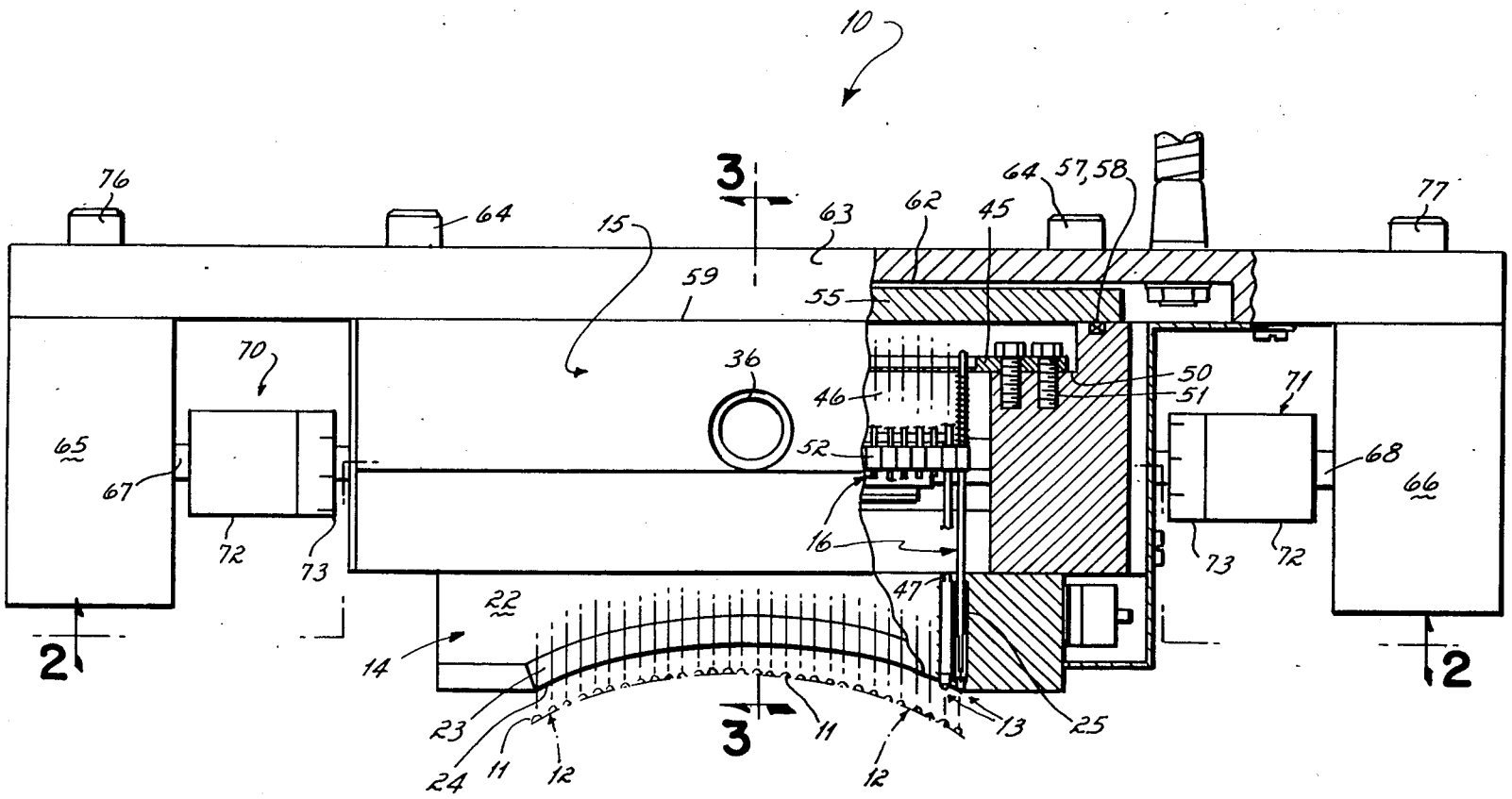
FIG. 1 is a side elevational view, partially broken away of a dispenser incorporating the invention of this application.
Figure 2:
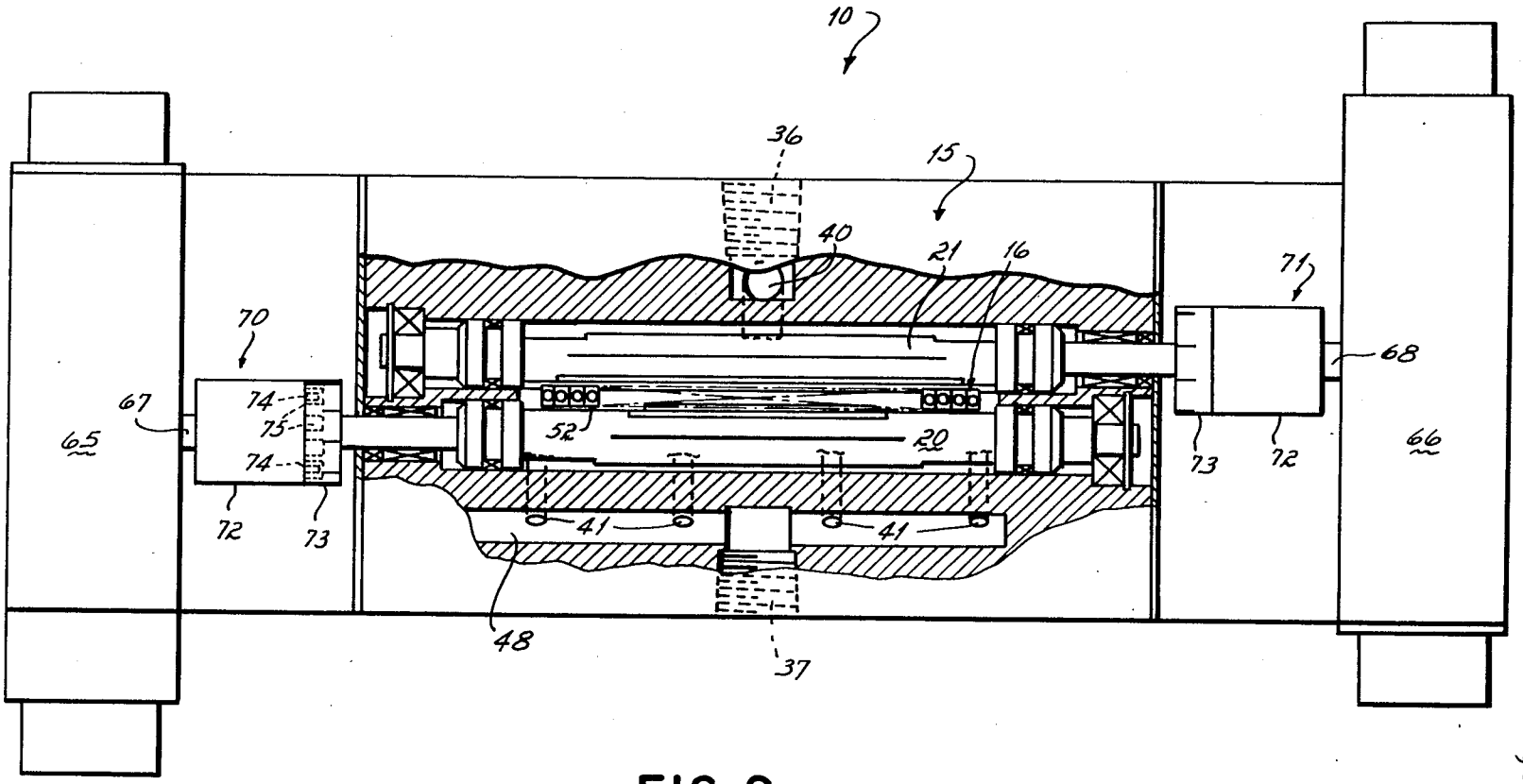
FIG. 2 is a cross sectional view of the dispenser taken on line 2—2 of FIG. 1.

With reference to the drawings, there is illustrated a dispensing device 10 for dispensing multiple parallel beads 11 of adhesive or other viscous liquid material onto a substrate 12. These beads 11 are each dispensed from individual nozzles 13 mounted within an extrusion head 14. This extrusion head 14 is in turn mounted upon and supported from the body 15 of the dispensing device 10. Mounted within this body 15 are a plurality of valve needles 16, the ends of which extend into and cooperate with valve seats 17 formed on the interior surface of the nozzles 13. As explained more fully hereinafter, opening and closing of these valve needles relative to the valve seats of the nozzles is controlled by oscillatory movement of one or a pair of cam shafts 20, 21 mounted internally of the body 15.

Figure 3:
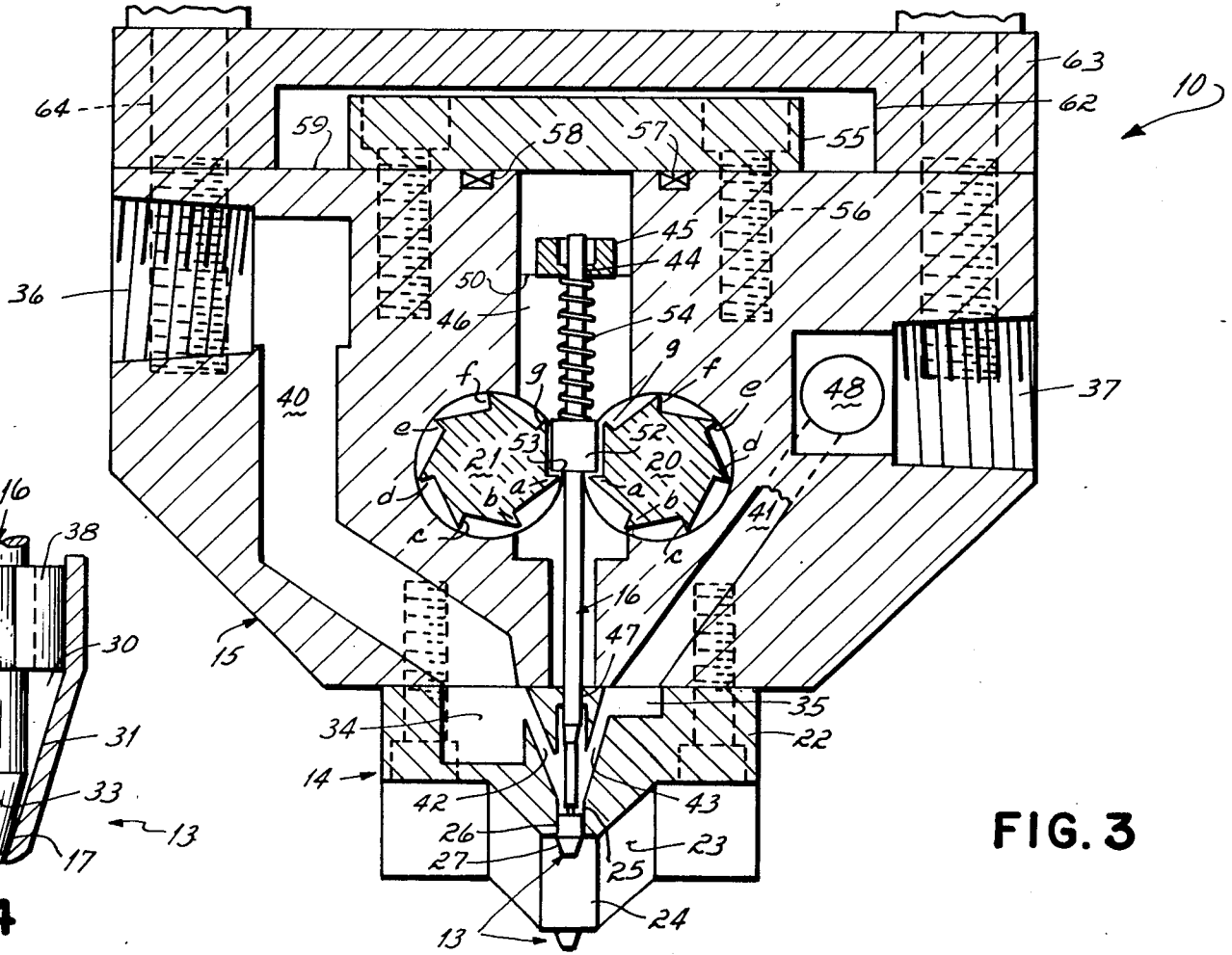
FIG. 3 is a cross sectional view of the dispenser taken on line 3—3 of FIG. 1.

With reference to FIGS. 1 and 3, it will be seen that the extrusion head 14 comprises a block of metal 22 from the underside of which there extends a generally tapered rib 23. This tapered rib 23 extends for the length of the block 22 and has a flat bottom surface 24 which is arcuate in configuration when viewed in side elevation, FIG. 1. This particular extrusion head 14 illustrated in the drawings is intended for use in applying adhesive to a book block in the course of a book binding application. In such an application, the adhesive is applied to an arcuate surface of approximately the same contour as the arcuate contour of the underside of the head 14.

Extending vertically through the extrusion head 14 there are a plurality of parallel vertical bores 25. In the illustrated embodiment there are thirty such bores, the lower ends of which intersect the flat surfaces 24 of the rib 23 on the bottom of the block. The nozzles 13 are fixedly mounted in the lower end of these bores and extend from the bottom surface 24 of the block.

Figure 4:
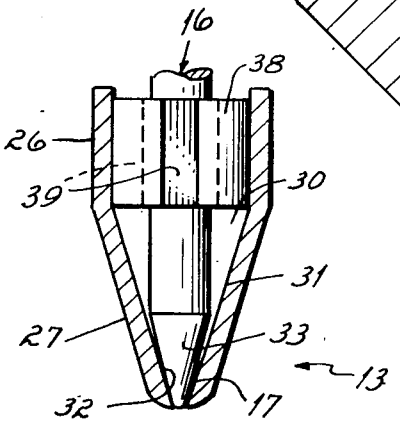
FIG. 4 is an exploded view of the valve seat portion of FIG. 3.

With reference now to FIG. 4, it will be seen that each nozzle 13 has a generally cylindrical upper body section 26 and a lower tapered section 27. An axial bore 30 extends through each nozzle and terminates in a tapered outlet port 31 which extends through the tapered end 27 of the nozzle. The lower end of this tapered port defines the valve seat 17 for the generally conical shaped end 33 of the valve needle 16. The needle valve 16 passes through and is guided by an axial bore in a guide ring 38. There are longitudinal passages 39 in the periphery of this ring through which adhesive flows from the upstream to the downstream side of the guide ring 38. A more detailed description of this nozzle and guide ring construction may be found in U.S. Pat. No. 4,465,212, assigned to the assignee of this application.

The extrusion head 14 has machined or formed in the top thereof a pair of spaced parallel slots 34, 35. Slot 34 is connected to a liquid entrance port 36 via an inlet passage 40 and slot 35 is connected to an exit port 37 of the body 15 via a plurality of return passages 41, and a cross flow passage 48. The slot 34 of the extrusion head functions as a distributor for liquid adhesive or other liquid material supplied to the dispensing device 10 via a conduit (not shown) adapted to be connected to the entrance port 36. Similarly, the slot 35 functions as a collector to return excessive adhesive or liquid from the extrusion head to the source of liquid material via a conduit (not shown) adapted to be connected to the exit port 37.

The liquid distributor slot 34 is connected to each of the bores 25 via a plurality of parallel cross flow passages 42. Similarly, the slot 35 of the extrusion head is connected to each of the bores 25 via cross flow passages 43 of the extrusion head 14.

The upper ends of the valve needles 16 pass through guide holes 44 of a spring back-up plate 45. This plate 45 extends above the top of a longitudinal slot 46 in the body 15 and functions as a guide for the upper ends of the valve needles, the lower ends of which are guided for reciprocating movement within reduced diameter sections 47 of the bores 25 in the extrusion head 14. With reference to FIG. 1 it will be seen that the ends of the spring back-up plate 45 rests atop a shelf-like surface 50 of the slot 46, and that the plate 45 is secured atop this surface by bolts 51.

Formed on each of the valve needles 16, there is a cam follower section or cam follower flange 52. This cam follower section 52 of the valve needle has a lower surface 53 engageable by an oscillating cam surface of one of the cam shafts 20, 21 to control opening and closing of the valve needle. Each valve needle is independently urged to a closed position by a compression spring 54 fitted over the upper end of the valve needle between a top surface of the cam follower section 52 of the valve and the underside of the spring back-up plate 45.

The upper end of the slot 46 of the body 15 is enclosed by a cap 55 secured to the top of the body 15 by bolts 56. A seal 57 is preferably contained within a slot 58 in the top surface 59 of the body 15 surrounding the longitudinal slot 46. The cap 55 is in turn located within a recess 62 formed in the underside of a cover plate 63. This cover plate is secured to the top surface 59 of the body 15 by bolts 64.

According to the practice of this invention, selected combinations of valve needles 16 may be simultaneously opened and closed under control of cam surfaces 20*a*–20*g* or 21*a*–21*g* as those surfaces are caused to oscillate relative to the cam follower sections 52 of the valve needles. The valve needles are lifted off of the valve seats 17 against the bias of the springs 54 by oscillation of one of the two shafts 20, 21. Each shaft 20, 21 has seven different cam surfaces a–g for a total of fourteen different surfaces machined thereon. Each of the fourteen individual cam surfaces is machined to a different length so that oscillation of one particular cam surface relative to the cam surface of the valve needles lifts a different number of valve needles off of their respective seats than does another cam surface. For example, cam surface 20*a* is machined to a length such that it will lift all thirty needles off of their respective valve seats 17 while cam surface 20*b* is machined to lift twenty-eight needles. With fourteen different cam surface lengths available, it is possible to lift as few as four or as many as thirty needles simultaneously, so long as there are increments of two needles between each surface 20*a*–20*g* and 21*a*–21*g*. In practice, in our preferred application it is possible with this combination to adjust pattern width of the pattern of liquid adhesive dispensed from the nozzle from about 0.35" (four center-most needles being simultaneously lifted off of their respective seats) up to about 2.95" (all 30 needles being simultaneously lifted off of their respective seats).

Oscillation of the cam shafts 20, 21 is independently controlled by a pair of conventional pneumatic rotary actuators 65, 66. Each actuator is operative to effect oscillation of one cam shaft, the actuator 65 controlling oscillation of the cam shaft 20 and the actuator 66 controlling oscillation of the cam shaft 21. These pneumatic rotary actuators are conventional commercially available pieces of equipment which per se form no part of the invention of this application. One such suitable pneumatic rotary actuator is manufactured by PHD, Inc. of Ft. Wayne, Ind. It comprises a reciprocable pneumatic actuated piston having a rack (not shown) formed on the piston shaft. This rack is engageable with a rotary pinion (not shown). The pinion in turn is connected to an output shaft 67, 68 such that reciprocation of the pneumatic piston effects oscillation of the pinion and attached output shaft 67, 68. Of course, other types of rotary actuators or motors could be used in place of the pneumatic rotary actuators 65, 66 to effect oscillatory motion of the shafts 67, 68.

Each output shaft 67, 68 of the rotary actuators 65, 66 is connected to the cam shafts 20, 21, respectively, by a two-piece coupling 70, 71. The two couplings are identical so that only one, the coupling 70, will be described in detail herein. This coupling comprises a flexible section 72 and an index ring 73. The flexible section 72 is utilized to accommodate any misalignment between the output shafts 67, 68 and the cam shafts 20, 21. Each index ring 73 is marked with indicia to indicate the position of the cam shaft associated with the coupling 70, 71. Two drive pins 74 project from the face of the flexible section 72 of the coupling and mate with one pair of seven pairs of holes 75 in the face of the index ring 73. The drive pins function to transmit torque between the two sections of the coupling and insure proper positioning of the cam shafts.

The actuators 65, 66 are secured to the cover plate 63 by screws 76, 77, respectively. To change the position of the cam shafts 20, 21, and thereby the selected cam surface 20*a*–20*g* or 21*a*–21*g* positioned beneath the cam followers 52 of the valve needles, the actuator mounting screws 76 or 77 are removed to enable the actuator 65 or 66 to be moved axially so as to disengage the two sections of the coupling 70, 71. With the coupling disengaged, the cam shaft together with the attached index ring 73 is free to be manually rotated until a selected cam surface is positioned beneath the cam followers of the valve needles. By rotating now free index ring of the cam shaft 20 or 21 clockwise, each cam surface a–g will sequentially engage the cam follower 52 of the valve needles 16 and push the needles up against the bias of spring 54 until the follower drops back to engage the next cam surface. After a desired pattern width has been aligned with the indicator of the flexible section of the coupling 70, 71, the actuator 65 or 66 is remounted on the cover plate 63 and the projecting pins 74 on the coupling are engaged with a corresponding pair of holes 75 in the index ring 73.

In the operation of the dispensing device 10 of this application, liquid material such as molten hot melt adhesive material, is supplied to the entrance port 36 of the gun body. This molten adhesive or other liquid material is supplied to the port 36 under pressure and is caused to flow through the gun even while all of the valve needles 16 remain closed. This continuous flow of adhesive occurs via the passages 40, 34, 42, 43, 35, 41 and 48 through the exit port 37 to the liquid supply source (not shown). By thus continuously circulating the liquid or adhesive through the dispenser, the liquid or adhesive is prevented from setting up or solidifying in the dispenser if the valves remain closed for a prolonged period of time. In the absence of such continuous flow some liquids, such as some molten adhesives, would either solidify, or because of prolonged exposure to heat, degrade and char. The continuous flow through the dispensers eliminates or minimizes the solidification or degradation problem.

In order to actuate the dispenser so as to cause adhesive or liquid to flow from the nozzles of the dispenser, one of the pneumatic rotary actuators 65, 66 is actuated by causing high pressure air to move to one end of the actuator and effect reciprocation of the piston (not shown) of that actuator. This linear movement of the piston is in turn translated into rotary movement of one output shaft 67 or 68, depending upon which rotary actuator was actuated, so as to cause one of the cam shafts 20 or 21 to be oscillated through an arcuate movement of approximately 20°. This arcuate oscillatory movement results in the cam surface of that cam shaft located beneath the cam follower surface 52 of the valve needles lifting selected valve needles off their associated seats. Depending upon the length of the cam surface a–g of the selected cam shaft then located beneath the cam surface 52 of the valve needles, a selected number of valve needles will be lifted off of the seat and then returned to the seat. The duration of the oscillatory motion and the period that the valve needles remain off of the valve seats so that there is flow from the nozzles associated with the selected needle valves, is controlled by the rotary actuator, which is in turn either manually or electrically controlled. The particular control of the pneumatic actuator whether manual or automatic is conventional and forms no part of the invention of this application.

The primary advantage of this invention is the ease with which it enables differing combinations of valve needles to be actuated by the cam shafts 20, 21 so as to vary the pattern of liquid dispensed from the nozzles 13. As many as all of the needles may be simultaneously actuated, (thirty in the illustrated embodiment) or as few as four may be actuated depending upon the desired width of the pattern to be dispensed from the dispenser. By selecting a different cam surface 20*a*–g or 21*a*–*g* to effect actuation of the valve needles, the patterns may be varied without any need for completely changing the gun or nozzles associated with the gun.

While we have described only a single preferred embodiment of our invention, persons skilled in this art will appreciate modifications and changes which may be made without departing from the spirit of our invention.

I claim:

1. A device for dispensing multiple closely spaced streams of liquid comprising a nozzle having a plurality of parallel axial bores therein, each of said axial bores having a valve seat located therein, each of said axial bores terminating in an outlet orifice located downstream of said valve seat, a plurality of axially movable valve needles, one of said axially movable valve needles being located within each of said bores, each of said valve needles having a valve section formed thereon, said valve section of each of said valve needles being engageable with the valve seat of the bore within which said valve needle is located, a cam surface on each of said valve needles, oscillatable actuator means engageable with said cam surface of each of said valve needles to control opening and closing movement of said valve needles relative to said valve seats of the bores within which said valve needles are located, adjusting means for selectively adjusting the number and location of said axially movable needle valves simultaneously engaged and actuated by said actuator means, said adjusting means comprising a rotatable cam, and said actuator means comprising a motor for effecting oscillation of said rotatable cam.

2. The dispensing device of claim 1 wherein said rotatable cam is a barrel cam having a plurality of radially spaced cam surfaces on the surface thereof each of said cam surfaces of said rotatable cam being selectively engageable with a different selected combination of said cam surfaces of said valve needles.

3. The dispensing device of claim 2 wherein said barrel cam is generally shaped as a cylinder having a plurality of longitudinally extending cam surfaces on the peripheral surface thereof.

4. A device for dispensing multiple closely spaced streams of liquid comprising a nozzle having a plurality of parallel axial bores therein, each of said axial bores having a valve seat located therein, each of said axial bores terminating in an outlet orifice located downstream of said valve seat, the axes of said axial bores all being located in a common plane, a plurality of axially movable valve needles, one of said axially movable valve needles being located within each of said bores, each of said valve needles having a valve section formed thereon, said valve section of each of said valve needles being engageable with the valve seat of the bore within which said valve needle is located, a cam surface on each of said valve needles, actuator means engageable with said cam surface of each of said valve needles to control opening and closing movement of said valve needles relative to said valve seats of the bores within which said valve needles are located, means for adjusting the number of said axially movable needle valves simultaneously engaged and actuated by said actuator means, said actuator means comprising a pair of cylindrical cams, said pair of cylindrical cams being located on opposite sides of the common plane within which said axial bores are located, and each of said cylindrical cams having a plurality of longitudinally extending cam surfaces on the peripheral surface thereof.

5. The dispensing device of claim 4 wherein said actuating means includes motor means for effecting oscillation of said cylindrical cams to effect opening and closing movement of said valve needles relative to said valve seats.

6. The dispensing device of claim 4 wherein each of said plurality of longitudinally extending cam surfaces of said cylindrical cams is of differing configuration than all of the other cam surfaces of said cylindrical cams so as to enable differing combinations of valve needles to be actuated by said cam surfaces of said cylindrical cams.

* * * * *